US007874789B2

(12) United States Patent
Sirakov et al.

(10) Patent No.: US 7,874,789 B2
(45) Date of Patent: Jan. 25, 2011

(54) COMPRESSOR AND COMPRESSOR HOUSING

(75) Inventors: Borislav Sirakov, Torrance, CA (US); Thomas Booth, Rancho Palos Verdes, CA (US); Nicolas Deschatrettes, Wigan (GB); Juniel Yin, Cranfield (GB); Gary Vrbas, Torrance, CA (US); Dennis Thoren, Torrance, TX (US); Peter R. Davies, Grandvillers (FR)

(73) Assignee: Honeywell International, Inc., Morristown, NJ (US)

( * ) Notice: Subject to any disclaimer, the term of this patent is extended or adjusted under 35 U.S.C. 154(b) by 866 days.

(21) Appl. No.: 11/697,417

(22) Filed: Apr. 6, 2007

(65) Prior Publication Data

US 2008/0247870 A1 Oct. 9, 2008

(51) Int. Cl.
*F04D 29/66* (2006.01)

(52) U.S. Cl. ..... 415/56.5; 415/58.4

(58) Field of Classification Search ..... 415/52.1, 415/56.5, 58.4, 58.5, 219.1
See application file for complete search history.

(56) References Cited

U.S. PATENT DOCUMENTS 6,361,270 B1 * 3/2002 Bennett ..... 415/57.2
2008/0247866 A1 * 10/2008 Sirakov et al. ..... 415/144

FOREIGN PATENT DOCUMENTS

EP 1482128 5/2003

* cited by examiner

*Primary Examiner*—Edward Look
*Assistant Examiner*—Ryan H Ellis
(74) *Attorney, Agent, or Firm*—Alston & Bird LLP

(57) ABSTRACT

A housing is disclosed for a compressor having a duct defining a main gas flow axis and blades that draw a fluid through the duct. The blades impart to the fluid a momentum along a main gas flow direction and a swirl. The housing includes a volute configured to extend substantially circumferentially around and fluidly communicate with the duct (at a first location). The volute may be configured to direct a fluid portion flowing thereinto from the duct to have a velocity with a component in a first circumferential direction generally aligned with the swirl. The housing may also include at least one conduit, such as a pipe, in fluid communication with the first volute. The conduit may be configured to redirect the fluid portion to have a velocity with a first component along the main gas flow axis in a direction opposite the main gas flow direction and a second component in a second circumferential direction opposite to the first circumferential direction.

20 Claims, 7 Drawing Sheets

COMPRESSOR AND COMPRESSOR HOUSING

BACKGROUND INFORMATION

The present disclosure relates to compressors used for compressing a fluid such as air, and more particularly relates to compressors and compressor housings for redirecting a portion of a compressor fluid.

Compressors, such as axial and centrifugal compressors, are used in a variety of applications for compressing fluids. Centrifugal compressors are particularly suitable for applications in which a relatively low overall pressure ratio is needed. A single-stage centrifugal compressor can achieve peak pressure ratios approaching about 4.0 and is much more compact in size than an axial flow compressor of equivalent pressure ratio. Accordingly, centrifugal compressors are commonly used in turbochargers for boosting the performance of gasoline and diesel engines for vehicles.

In various applications, it is important for the compressor to have a wide operating envelope, as measured between the "choke line" at which the mass flow rate through the compressor reaches a maximum possible value because of sonic flow conditions in the compressor blade passages, and the "surge line" at which the compressor begins to surge with reduction in flow at constant pressure ratio or increase in pressure ratio at constant flow. Compressor surge is a compression system instability associated with flow oscillations through the whole compressor system. It is usually initiated by aerodynamic stall or flow separation in one or more of the compressor components as a result of exceeding the limiting flow incidence angle to the compressor blades or exceeding the limiting flow passage loading. For example, in a turbocharger, compressor surge can occur when the engine is operating at high load or torque and low engine speed, or when the engine is operating at a low engine speed with a high rate of exhaust fluid recirculation from the engine exhaust side to the intake side. Compressor surge can also occur when a relatively high specific torque output is required of an engine with a variable nozzle turbine (VNT) or an electrically assisted turbocharger. Additionally, surge can occur when a quick boosting response is required using an electrically assisted turbocharger and/or VNT turbocharger, or when the engine is suddenly decelerated, e.g., if the throttle valve is closed while shifting between gears.

As a result of any of the foregoing operating conditions, the compressor can surge as the axial component of absolute flow velocity entering the compressor is low in comparison to the blade tip speed in the tangential direction, thus resulting in the blades of the compressor operating at a high incidence angle, which leads to flow separation and/or stalling of the blades. Compressor surge can cause severe aerodynamic fluctuation in the compressor, increase the noise of the compressor, and reduce the efficiency of the compressor. In some cases, compressor surge can result in damage to the engine or its intake pipe system.

Thus, there exists a need for an improved apparatus and method for providing compressed fluid, such as in a turbocharger, while reducing the occurrence of compressor surge. In some cases, the prevention of compressor surge can expand the useful operating range of the compressor.

BRIEF SUMMARY OF THE DISCLOSURE

The present disclosure is directed to a compressor and/or compressor housing for redirecting a portion of a fluid being compressed. Such redirection of the fluid may be followed in some cases by recirculation of the affected fluid in order to modify or improve an aspect of compressor performance.

One aspect of the disclosure is directed to a housing for a compressor. Specifically, the housing is incorporated as part of a compressor having a duct defining a main gas flow axis and blades that draw a fluid through the duct. As such, the blades impart to the fluid a momentum along a main gas flow direction and a swirl. The housing includes a volute configured to extend substantially circumferentially around and fluidly communicate with the duct at a first location. This volute may be in addition to a standard discharge volute that may be incorporated into the compressor housing. The volute may be configured to direct a fluid portion flowing thereinto from the duct to have a velocity with a component in a first circumferential direction generally aligned with the swirl. The housing may also include at least one conduit, such as a pipe, in fluid communication with the first volute. The conduit may be configured to receive the fluid portion from the volute and to redirect the fluid portion to have a velocity with a first component along the main gas flow axis in a direction opposite the main gas flow direction and a second component in a second circumferential direction opposite to the first circumferential direction.

The conduit may include an entrance region configured to receive fluid flowing therein having a velocity with a component in the first circumferential direction, and may further include an exit region configured to direct fluid flowing therein to have a velocity with a component along the second circumferential direction. A smooth transition may be included between the entrance and exit regions. In some embodiments, the conduit may be configured such that a cross section thereof is spatially separate from a cross section of the duct.

The housing may additionally include a supplemental volute, which is configured to extend substantially circumferentially around and fluidly communicate with the duct, possibly at a second location that is spaced upstream from the first location along the main gas flow axis. When a supplemental volute is included, the conduit may extend between the volute and the supplemental volute. The conduit fluidly communicates with the supplemental volute such that the fluid portion flows from the conduit into the supplemental volute and is directed by the supplemental volute to have a velocity with a component in the second circumferential direction. In some embodiments, the supplemental volute may be substantially closed off from the duct and may include an exit port that extends only partially around the supplemental volute for fluidly communicating with the duct. The exit port may be configured to direct fluid flowing therethrough into the duct with a velocity with a first component in the main gas flow direction and a second component in the second circumferential direction. In some embodiments, the housing may also include a discharge volute configured to receive fluid compressed by the compressor blades and to supply fluid to a component separate from the compressor Another aspect of the disclosure is directed to a housing for a compressor, the compressor having a duct defining a main gas flow axis and blades that draw a fluid through the duct and impart thereto a momentum along a main gas flow direction and a swirl. The housing includes a first volute configured to extend substantially circumferentially around and fluidly communicate at a first location with the duct; at least a second volute configured to extend substantially circumferentially around and fluidly communicate with the duct at a second location spaced along the main gas flow axis from the first location; and at least one conduit providing fluid communication between said first and at least second volutes, said at least one conduit defining a conduit axis that is spaced apart from the main gas flow axis.

Yet another aspect of the disclosure is directed to a housing for a compressor, the compressor having a duct defining a main gas flow axis and blades that draw a fluid through the duct and impart thereto a momentum along a main gas flow direction and a swirl, said housing comprising: a first volute configured to extend substantially circumferentially around and fluidly communicate with the duct; a second volute configured to extend substantially circumferentially around and fluidly communicate with the duct, said second volute being substantially closed off from said duct and including an exit port for fluidly communicating with the compressor inlet. The housing further includes at least one conduit providing fluid communication between the first and second volutes.

In one embodiment, the conduit is configured to accept the fluid portion from said first volute and to redirect the fluid portion to have a velocity with a first component along the main gas flow axis in a direction opposite the main gas flow direction and a second component in a second circumferential direction opposite to the first circumferential direction.

Still another aspect of the disclosure is directed to a compressor. The compressor includes a duct defining a main gas flow axis and a row of compressor blades that draw a fluid through the duct. The blades impart to the fluid a momentum along a main gas flow direction and a swirl. A discharge volute is configured to receive fluid compressed by the compressor blades and to supply fluid to a component separate from the compressor. A housing includes a first volute configured to extend substantially circumferentially around and fluidly communicate with the duct. The first volute may be configured to direct a fluid portion flowing thereinto from the duct to have a velocity with a component in a first circumferential direction generally aligned with the swirl. The housing may also include a bleed passage that provides fluid communication between the duct and the first volute, the bleed passage being located intermediate a leading edge and a trailing edge of the row of compressor blades. The housing further includes a second volute configured to extend substantially circumferentially around and fluidly communicate with the duct. The second volute may be substantially closed off from said duct and include an exit port for fluidly communicating with the duct. The exit port may extend only partially around the second volute, and may be configured to direct fluid flowing therethrough into the duct with a velocity with a first component in the main gas flow direction and a second component in the second circumferential direction. The housing still further includes at least one conduit providing fluid communication between the first volute and second volutes. The conduit may include an entrance region proximal to the first volute and configured to receive therein the fluid portion having the velocity with the component in the first circumferential direction. The conduit may also include an exit region proximal to the second volute and configured to direct the fluid portion to have a velocity with a component along the second circumferential direction opposed to the first circumferential direction. A smooth transition may be included in the conduit between the entrance and exit regions. The second volute may be configured to receive the fluid portion from the exit region and to direct the fluid portion to have a velocity with a component in the second circumferential direction.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 2A:
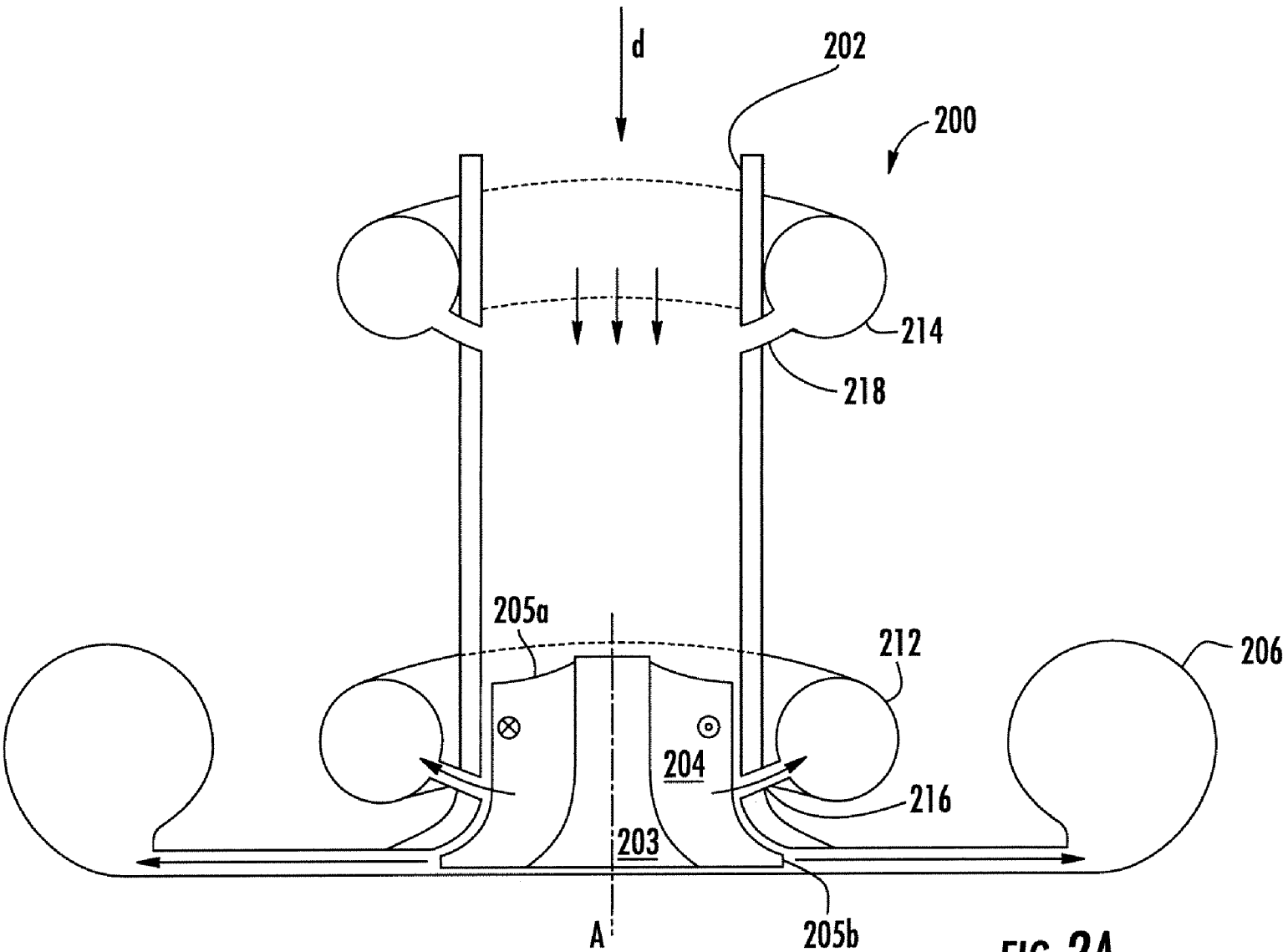
FIG. 2A is a cross-sectional view of the centrifugal compressor of FIG. 1A, schematically illustrating the theoretical fluid flow pattern created by the compressor blades in the compressor duct during operation of the compressor.
Figure 2B:
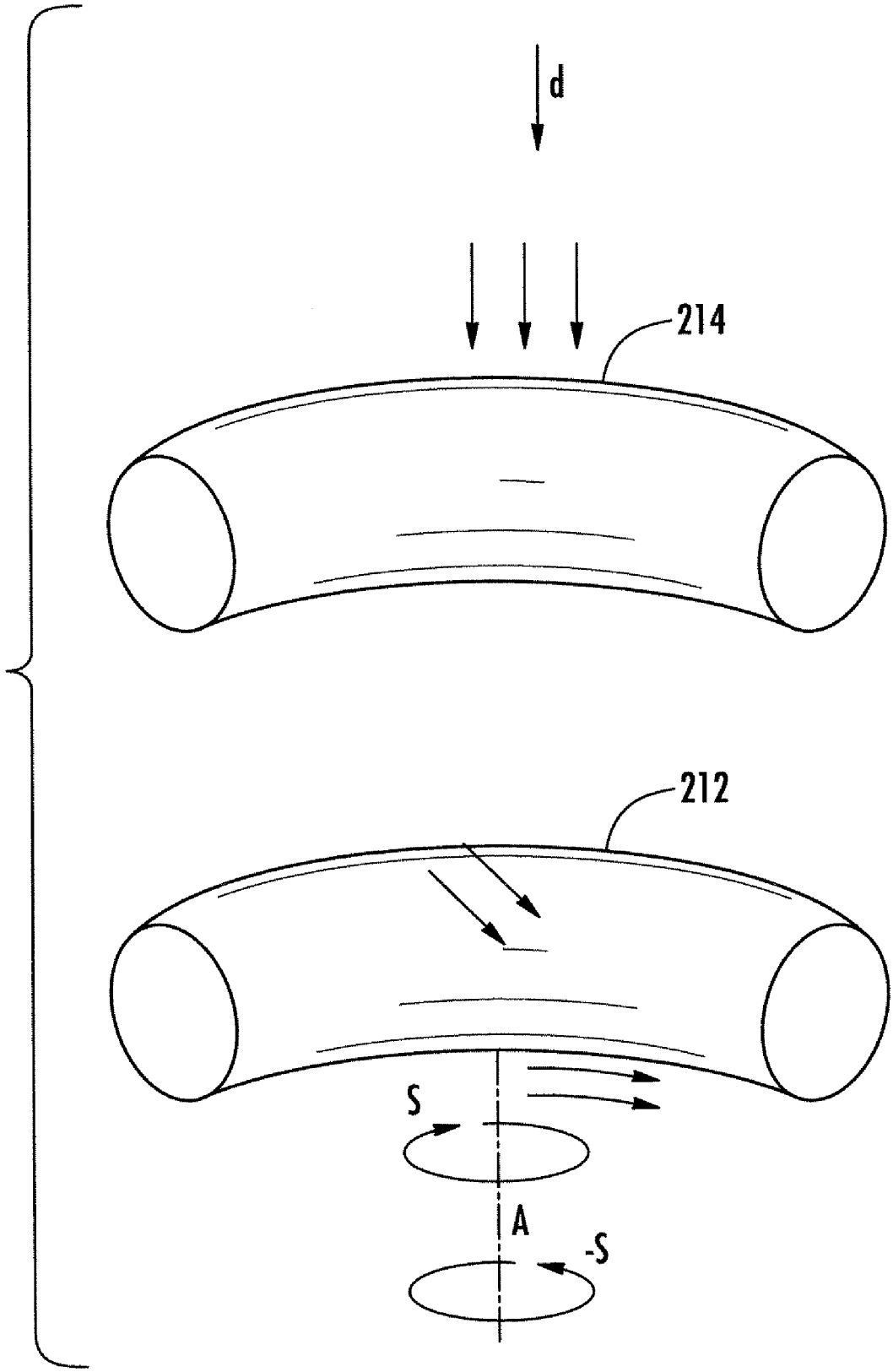
FIG. 2B is a perspective cross-sectional view of the compressor of FIG. 2A, further schematically illustrating the theoretical fluid flow pattern created by the compressor blades in the compressor duct during operation of the compressor.
Figure 2C:
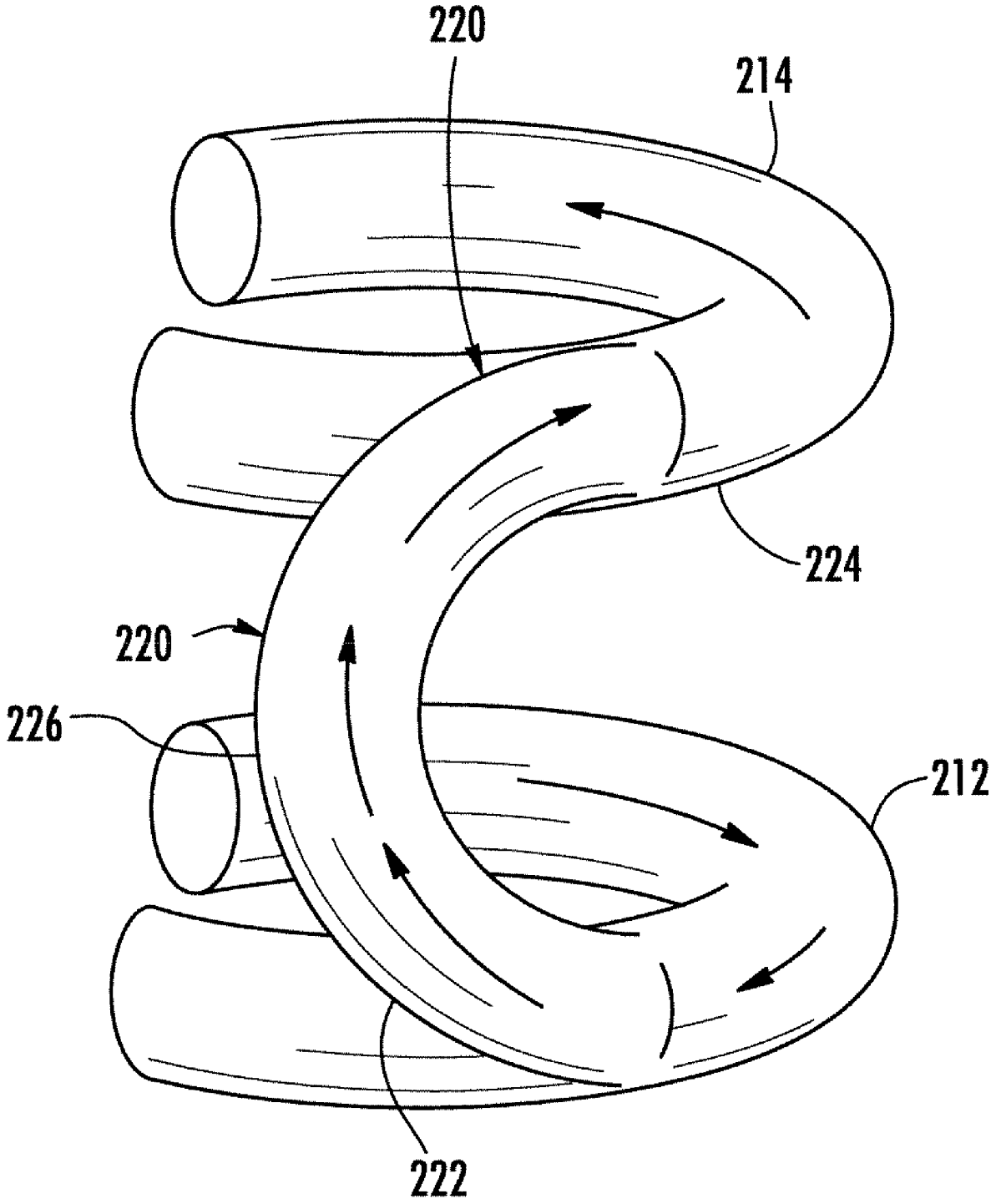
Figure 2D:
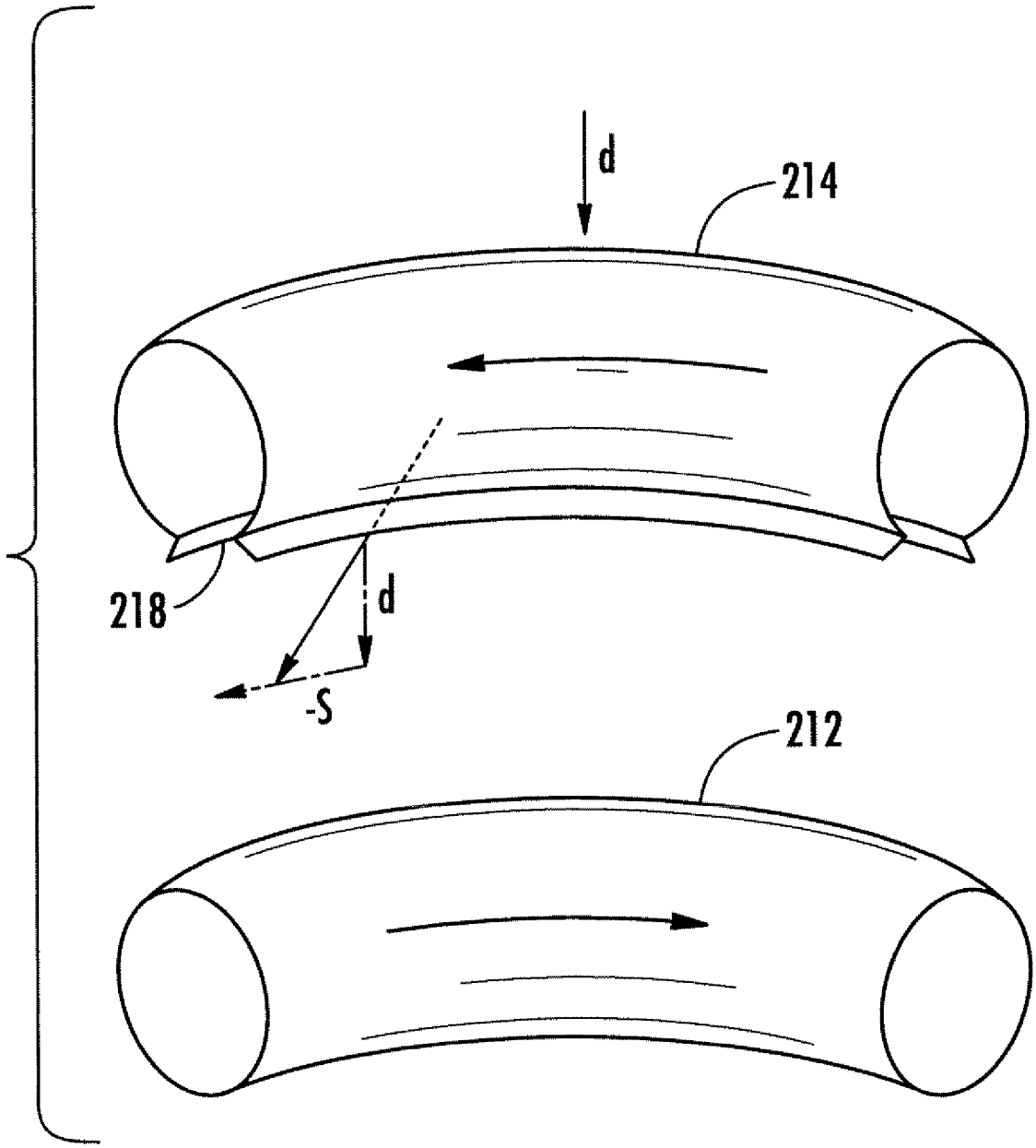

FIG. 2C is a perspective view in partial cross-section of the volutes and conduit of the compressor of FIG. 2A, schematically illustrating the pattern of fluid flow therein; and FIG. 2D is a perspective cross-sectional view of the compressor of FIG. 2A, schematically illustrating both the theoretical fluid flow pattern created by the compressor blades in the compressor duct during operation of the compressor and the theoretical fluid flow pattern established by the exit port.

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
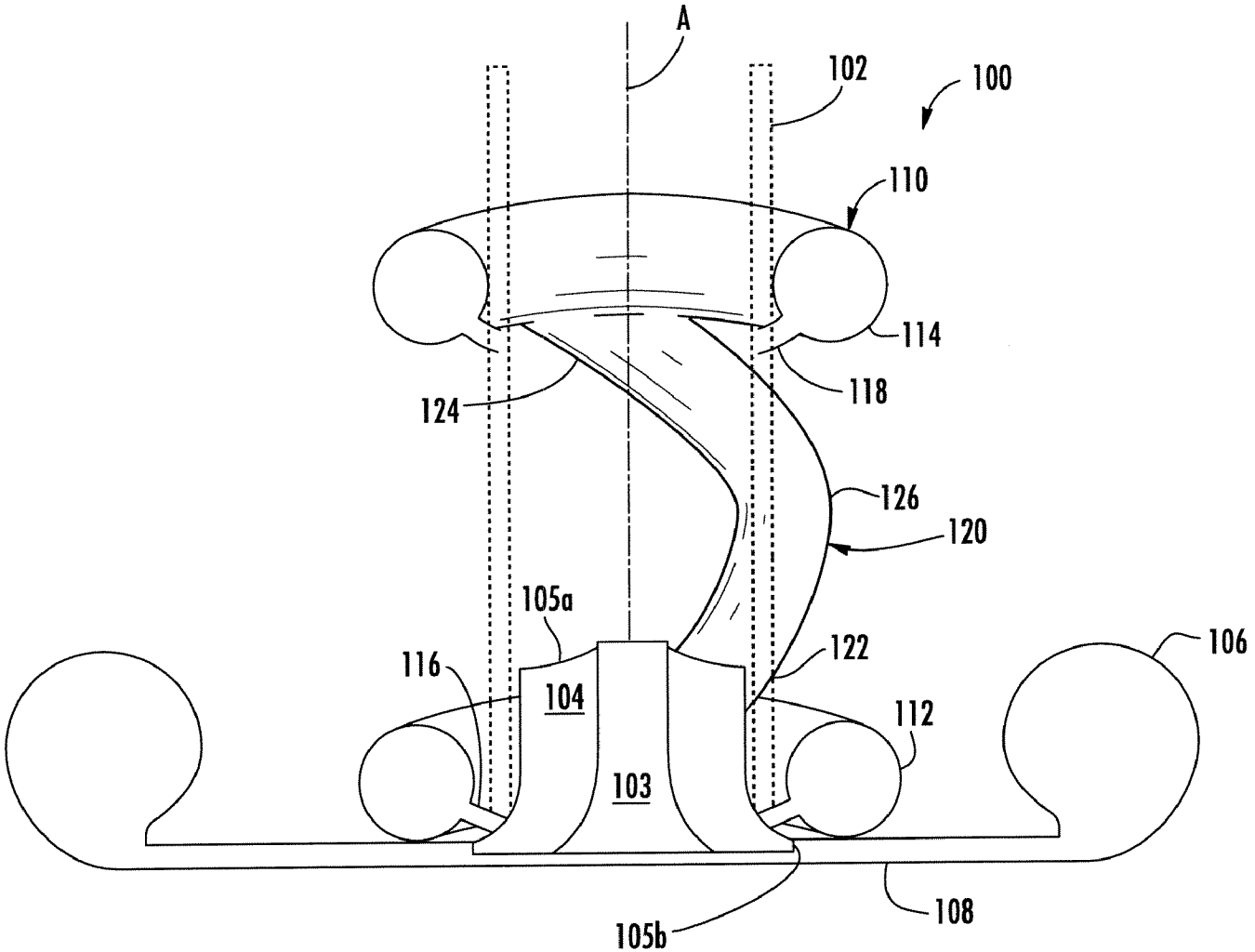
FIG. 1A is a cross-sectional view of a centrifugal compressor in accordance with an exemplary embodiment.
Figure 1B:
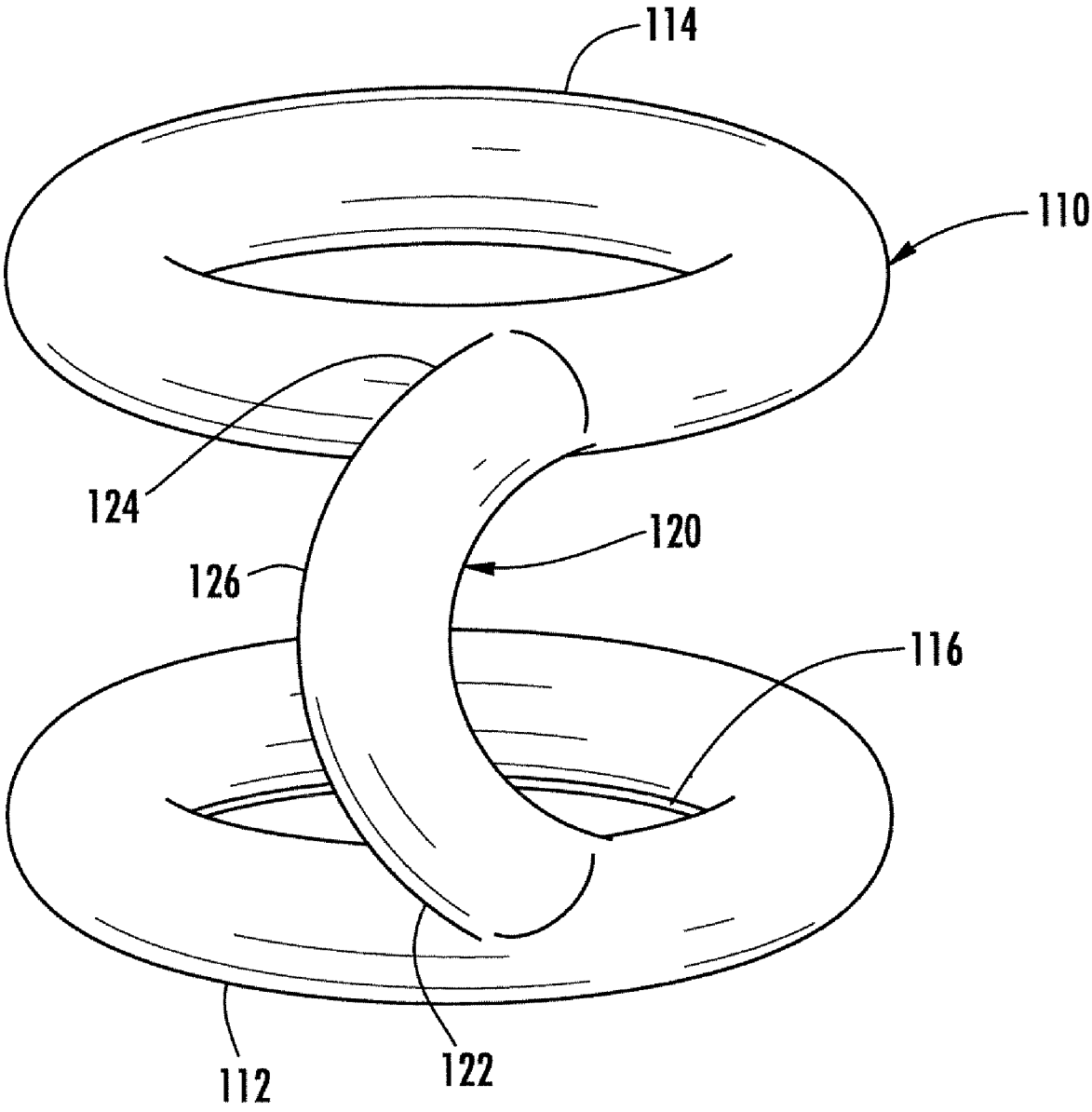
FIG. 1B is a perspective view of a portion of the housing of the compressor of FIG. 1A, showing the associated volutes and conduit.
Figure 1C:
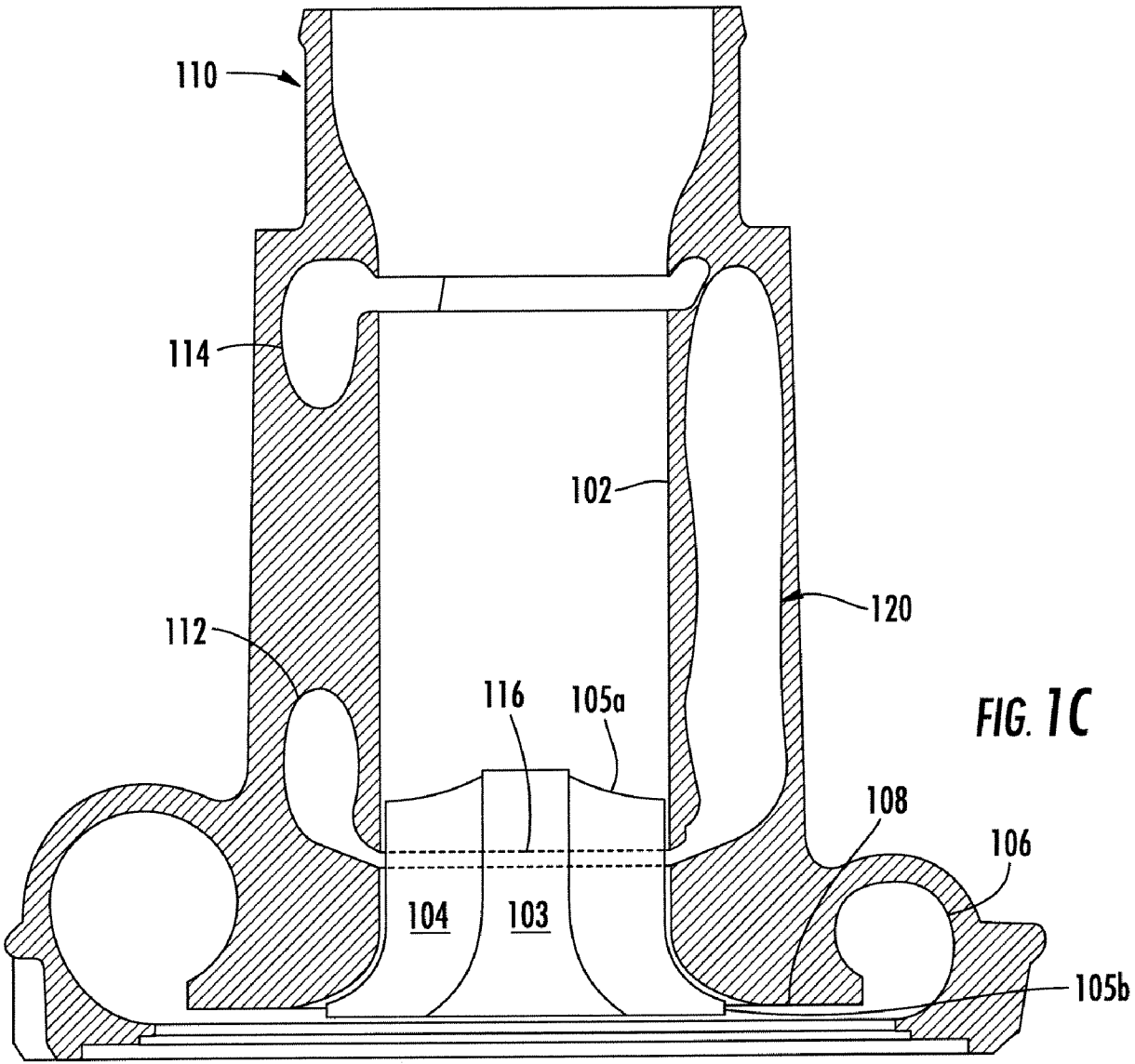
FIG. 1C is a cross-sectional view of a compressor housing configured in accordance with another exemplary embodiment, in which the volutes and conduit are integrated with the compressor duct.

Referring to FIGS. 1A-1C, therein is shown a centrifugal compressor 100 configured in accordance with an exemplary embodiment. The compressor 100 includes a duct 102, which defines a main gas flow axis A. The compressor also includes a row of compressor blades 104 disposed towards an end of the duct 102. The compressor blades 104 extend from a hub 103 that is coupled to a shaft (not shown). The shaft is rotatable about axis A and is driven by a device such as a turbine or electric motor (not shown). Some embodiments of compressor blades 104 may define a blade leading edge 105*a* and a blade trailing edge 105*b*. Surrounding the blades is a discharge volute 106, which fluidly communicates with the duct via a diffuser passage 108. The discharge volute 106 generally serves to transfer the compressed fluid to the point of use, such as the combustion chamber of an engine.

The compressor 100 also includes a housing 110, which may or may not be integrated with the duct 102. The housing 110 may include a first volute 112 and, in some cases, a second volute 114 (also respectively referred to as "volute" and "supplemental volute"). The first and second volutes 112, 114 may be configured to extend substantially circumferentially around and to fluidly communicate with the duct 102. For example, the first volute 112 may communicate with the duct 102 via a bleed passage 116, which may extend circumferentially around duct 102. Bleed passage 116 may be located beyond blade leading edge 105*a*, beyond blade trailing edge 105*b*, or intermediate blade leading edge 105*a* and blade trailing edge 105*b*. In some embodiments, second volute 114 may be substantially closed off from duct 102, with an exit port 118 providing the main, or perhaps only, fluid communication between second volute 114 and duct 102. In some embodiments, first volute is spaced along axis A from second volute in direction d. The locations at which first volute 112 and second volute 114 respectively fluidly communicate with duct 102, such as via bleed passage 116 and exit port 118, respectively, may be similarly spaced apart.

Housing 110 may also include at least one conduit 120, such as a pipe or a channel, providing fluid communication between first volute 112 and second volute 114. Generally, conduit 120 may be configured such that a cross section of conduit 120 is spatially separate from a cross section of duct 102, and as such, conduit 120 provides a secondary gas flow path along which fluid may flow in a direction with a component substantially opposite the main gas flow direction d. Conduit 120 may include an entrance region 122 proximal to first volute 112 and an exit region 124 proximal to second volute 114, and may have a (possibly smooth) transition region 126 between the entrance and exit regions 122, 124. In embodiments lacking a second volute, conduit 220 may include an exit region 124 that fluidly communicates with duct 102, and the exit region 124 may extend partially or almost completely around duct 102 (for configurations in which conduit 220 extends almost completely around duct 102, conduit 120 tends to replace the function of a second volute).

Referring to FIGS. 2A-2D, during operation of the compressor 200, the compressor blades 204 rotate to impart to the compressor fluid a momentum along a main gas flow direction d and an angular velocity or swirl s. Under the influence of the rotating compressor blades, air, or another fluid to be compressed (generally referred to as the "compressor fluid"), is drawn through the duct 202 along axis A in direction d. Much of the compressor fluid is urged by compressor blades 204 into discharge volute 206. However, a portion of the compressor fluid will tend to flow through bleed passage 216 into first volute 212. This fluid portion tends to enter first volute 212 with swirl s. First volute 212, due to its geometry, is configured to direct the fluid portion flowing thereinto to have a velocity with a component in a first circumferential direction that is generally aligned with the swirl s.

The portion of the compressor fluid that enters first volute 212 tends to travel from first volute 212 into conduit 220. Conduit 220 may be configured to receive fluid having a velocity aligned with the swirl s, such as the fluid flowing in first volute 212. For example, conduit 220 may have an entrance region 222 that gradually branches from first volute 212. Conduit 220 may also be configured to direct fluid flowing therethrough to have a velocity with a component along a second circumferential direction that is opposed to the first circumferential direction (i.e., opposed to swirl s, or in the "−s" direction). As such, conduit 220 may act to redirect the fluid flowing therein and to reverse the circumferential component of fluid velocity. For example, conduit 220 may be configured to physically reverse direction such that a fluid flowing through conduit 220 will similarly reverse direction. This reversal of direction may be effected by incorporating into conduit 220 an exit region 224 directed in the −s direction and a transition region 226 that connects the entrance region 222 and exit region 224 and turns back on itself.

The fluid portion traveling in conduit 220 may be received by second volute 214, for example, by configuring exit region 224 and second volutes 214 such that exit region 224 gradually merges with second volute 214. Second volute 214 is then configured to direct the received fluid portion to have a velocity with a component in the second circumferential direction. Second volute 214 may be substantially closed off from duct 202 other than by exit port 218. Exit port 218 may be configured such that fluid flowing therefrom has a velocity with a component along axis A and a component in the direction −s opposed to the swirl s (as illustrated schematically in FIG. 2D). The fluid so emanating from exit port 218 is essentially re-circulated, as it is introduced into duct 202 along with external fluid drawn in from outside compressor 200. Such external fluid generally has a velocity directed along axis A (as illustrated schematically in FIGS. 2B and 2D). As such, the external fluid generally has a velocity aligned with that of the fluid entering duct 202 from exit port 218. It is noted that the axial and circumferential components of velocity for fluid being re-circulated from exit port 218 may be controlled by adjusting the extent to which fluid must flow through second volute 214 and/or conduit 220 before being released into duct 202, as well as by adjusting the geometry of exit port 218.

In accordance with at least some of the embodiments described herein, the re-circulated injected fluid is able to cause a redistribution of the flow field in the compressor. This can have a beneficial impact on the surge phenomenon. It is further believed that imparting to the re-circulated injected fluid both an axial velocity component and a rotational velocity component opposed to the swirl, through the acceleration of the fluid by the conduit and associated volutes oriented as described above, contributes to the ability to beneficially impact the surge phenomenon.

Many modifications and other embodiments of the inventions set forth herein will come to mind to one skilled in the art to which these inventions pertain having the benefit of the teachings presented in the foregoing descriptions and the associated drawings. For example, while the previously described embodiments invoke a centrifugal compressor, various types of compressors may be configured consistently with the present disclosure, including any type of compressor that imparts both linear and angular momentum to a fluid being compressed thereby. Also, some embodiments may utilize only a single volute, the lone volute being connected to a conduit that serves to reverse the direction of flow before injecting the reversed flow into the duct of the compressor. Further, some embodiments may employ several conduits, such as a series of pipes or channels, distributed around the compressor. Finally, in some embodiments, the housing for the compressor may only include one volute, that being the discharge volute, from which a conduit extends. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A housing for a compressor, the compressor having a duct defining a main gas flow axis and blades that draw a fluid through the duct and impart thereto a momentum along a main gas flow direction and a swirl, said housing comprising:

a volute configured to extend substantially circumferentially around and fluidly communicate with the duct, said volute being configured to direct a fluid portion flowing thereinto from the duct to have a velocity with a component in a first circumferential direction generally aligned with the swirl; and at least one conduit in fluid communication with said volute and configured to redirect the fluid portion to have a velocity with a first component along the main gas flow axis in a direction opposite the main gas flow direction and a second component in a second circumferential direction opposite to the first circumferential direction.

2. A housing according to claim 1, further comprising a supplemental volute configured to extend substantially circumferentially around and fluidly communicate with the duct, and wherein said at least one conduit extends between said volute and said supplemental volute and fluidly communicates with said supplemental volute such that the fluid portion flows from said at least one conduit into said supplemental volute and is directed by said supplemental volute to have a velocity with a component in the second circumferential direction.

3. A housing according to claim 2, wherein said supplemental volute is substantially closed off from the duct and includes an exit port for fluidly communicating with the duct.

4. A housing according to claim 3, wherein said exit port is configured to direct fluid flowing therethrough into the duct with a velocity with a first component in the main gas flow direction and a second component in the second circumferential direction.

5. A housing according to claim 2, wherein said supplemental volute is configured to fluidly communicate with the duct at a second location and said volute is configured to fluidly communicate with the duct at a first location spaced from the second location along the main gas flow axis.

6. A housing according to claim 1, wherein said at least one conduit includes an entrance region configured to receive fluid flowing therein having a velocity with a component in the first circumferential direction and an exit region configured to direct fluid flowing therein to have a velocity with a component along the second circumferential direction.

7. A housing according to claim 6, wherein said at least one conduit is configured to have a smooth transition between said entrance and exit regions.

8. A housing according to claim 6, wherein said at least one conduit is a single pipe configured to have a cross section that is spatially separate from a cross section of the duct.

9. A housing according to claim 1, wherein said at least one conduit is configured such that a cross section thereof is spatially separate from a cross section of the duct.

10. A housing according to claim 1, further comprising a discharge volute configured to receive fluid compressed by the blades and to supply fluid to a component separate from the compressor.

11. A housing for a compressor, the compressor having a duct defining a main gas flow axis and blades that draw a fluid through the duct and impart thereto a momentum along a main gas flow direction and a swirl, said housing comprising:

a first volute configured to extend substantially circumferentially around and fluidly communicate at a first location with the duct, said first volute being configured to direct a fluid portion flowing thereinto from the duct to have a velocity with a component in a first circumferential direction generally aligned with the swirl;

at least a second volute configured to extend substantially circumferentially around and fluidly communicate with the duct at a second location spaced along the main gas flow axis from the first location; and at least one conduit providing fluid communication between said first and at least second volutes, said at least one conduit defining a conduit axis that is spaced apart from the main gas flow axis, wherein said at least one conduit is configured to accept the fluid portion from said first volute and to redirect the fluid portion to have a velocity with a first component along the main gas flow axis in a direction opposite the main gas flow direction and a second component in a second circumferential direction opposite to the first circumferential direction.

12. A housing according to claim 11, wherein said at least one conduit is a single pipe with a cross section configured to be spatially separate from a cross section of the duct.

13. A housing for a compressor, the compressor having a duct defining a main gas flow axis and blades that draw a fluid through the duct and impart thereto a momentum along a main gas flow direction and a swirl, said housing comprising:

a first volute configured to extend substantially circumferentially around and fluidly communicate with the duct, said first volute being configured to direct a fluid portion flowing thereinto from the duct to have a velocity with a component in a first circumferential direction generally aligned with the swirl;

a second volute configured to extend substantially circumferentially around and fluidly communicate with the duct, said second volute being substantially closed off from said duct and including an exit port for fluidly communicating with the compressor inlet; and at least one conduit providing fluid communication between said first and second volutes, wherein said at least one conduit is configured to accept a fluid portion from said first volute and to redirect the fluid portion to have a velocity with a first component along the main gas flow axis in a direction opposite the main gas flow direction and a second component in a second circumferential direction opposite to the first circumferential direction.

14. A compressor comprising:

a duct defining a main gas flow axis;

a row of compressor blades that draw a fluid through the duct and impart thereto a momentum along a main gas flow direction and a swirl;

a discharge volute configured to receive fluid compressed by said row of compressor blades and to supply fluid to a component separate from said compressor; and a housing comprising:

a first volute configured to extend substantially circumferentially around and fluidly communicate with the duct, said first volute being configured to direct a fluid portion flowing thereinto from said duct to have a velocity with a component in a first circumferential direction generally aligned with the swirl;

a second volute configured to extend substantially circumferentially around and fluidly communicate with said duct; and at least one conduit providing fluid communication between said first volute and said second volute, wherein said at least one conduit includes an entrance region proximal to said first volute and configured to receive therein the fluid portion having the velocity with the component in the first circumferential direction and an exit region proximal to said second volute and configured to direct the fluid portion to have a velocity with a component along the second circumferential direction opposed to the first circumferential direction, and wherein said second volute is configured to receive the fluid portion from said exit region and to direct the fluid portion to have a velocity with a component in the second circumferential direction.

15. A compressor according to claim 14, wherein said second volute is substantially closed off from said duct and includes an exit port for fluidly communicating with the duct.

16. A compressor according to claim 15, wherein said first volute is configured to fluidly communicate with said duct at a first location along the main gas flow axis and said second volute is configured to fluidly communicate with said duct via said exit port at a second location along the main gas flow axis, the first location being spaced along the main gas flow direction from the second location.

17. A compressor according to claim 15, wherein said exit port is configured to direct fluid flowing therethrough into the duct with a velocity with a first component in the main gas flow direction and a second component in the second circumferential direction.

18. A compressor according to claim 14, wherein said at least one conduit is a single pipe configured such that a cross section of said pipe is spatially separate from a cross section of the duct.

19. A compressor according to claim 14, wherein said at least one conduit is configured to have a smooth transition between said entrance and exit regions.

20. A compressor according to claim 14, wherein said housing further comprises a bleed passage that provides fluid communication between said duct and said first volute, said bleed passage being located intermediate a leading edge and a trailing edge of said row of compressor blades.

* * * * *